US007063274B2

(12) United States Patent
Feller et al.

(10) Patent No.: US 7,063,274 B2
(45) Date of Patent: Jun. 20, 2006

(54) CLEANING NOZZLE

(75) Inventors: Roland Feller, Schorndorf (DE); Ernst Steinhilber, Möglingen (DE)

(73) Assignee: Spraying Systems Deutschland GmbH, Remshalden-Grunach (DE)

( * ) Notice: Subject to any disclaimer, the term of this patent is extended or adjusted under 35 U.S.C. 154(b) by 0 days.

(21) Appl. No.: 09/785,962

(22) Filed: Feb. 16, 2001

(65) Prior Publication Data

US 2001/0017323 A1 Aug. 30, 2001

(30) Foreign Application Priority Data

Feb. 16, 2000 (DE) ..... 100 06 864

(51) Int. Cl.
*B05B 3/06* (2006.01)

(52) U.S. Cl. ..... 239/252; 239/261; 239/381

(58) Field of Classification Search ..... 239/222, 239/222.11, 222.17, 222.19, 222.21, 230, 239/237, 231, 240, 252, 251, 261, 463, 466, 239/474, 487, 488, 491, 381, 382, 383
See application file for complete search history.

(56) References Cited

U.S. PATENT DOCUMENTS

| | | | | | |
|---|---|---|---|---|---|
| 10,051 | A | * | 9/1853 | Jones | 148/625 |
| 3,125,297 | A | * | 3/1964 | Copeland et al. | 239/261 |
| 3,809,317 | A | * | 5/1974 | Bender | 239/251 |
| 4,715,538 | A | * | 12/1987 | Lingnau | 239/248 |

* cited by examiner

*Primary Examiner*—Christopher Kim
(74) *Attorney, Agent, or Firm*—Leydig, Voit & Mayer Ltd.

(57) ABSTRACT

A nozzle for use in cleaning applications is provided. The nozzle has a rotatably supported nozzle body, on which one or more nozzle orifices are provided. The nozzle housing itself serves as the rotary drive, which is carried along by a fluid led into the housing with torque. In order to stabilize the drive action, at least one braking device is provided on the nozzle which generates a braking torque by fluid action, preferably through the recoil on a nozzle opening.

27 Claims, 6 Drawing Sheets

CLEANING NOZZLE

FIELD OF THE INVENTION

The invention relates to a spray nozzle which can be used especially for cleaning the inner walls of containers, tanks and the like. More particularly, the invention relates to such a cleaning nozzles which rotates in operation, and in which the fluid flowing through serves to drive the rotation.

BACKGROUND OF THE INVENTION

On the one hand, cleaning nozzles should already be capable of operating under low working pressures, for example from approximately 0.5 bar. On the other hand, the nozzles should not have too high a rate of rotation when higher operating pressures are used, for example pressures above 20 bar. A rate of rotation of the nozzles that is too high impairs the cleaning effect.

A nozzle that rotates in operation and is driven by a fluid is known from BE-A 720 408. The nozzle has a cylindrical housing in which a hollow shaft is rotatably supported by ball bearings. The upper end of the hollow shaft is arranged with an axial connection which serves for feeding a fluid. On the lower end of the shaft, a nozzle head is provided, which rotates with the shaft. In the nozzle head, a distributor pipe is provided which communicates with the shaft. The distributor pipe is arranged on both sides of the shaft, transversely to the shaft, and carries on its ends in each case transversely branching-off orifices. The rotatably supported distributor pipe carries a gear wheel which rolls off on a gear wheel fastened to the housing. Thereby, the orifices are also made to rotate about the horizontal distributor pipe axis, in addition to their rotation about the vertical axis.

A turbine which is torsionally joined with the hollow shaft serves as the drive. The turbine has a runner with several obliquely set blades. The runner is arranged in a housing which has five face-side oblique bores for fluid inlet. This guides the fluid into the space between the turbine and the housing in such manner that the rotating turbine is also self-braked with increasing operating pressure, and its rate of rotation does not rise above a certain limit.

The nozzle has a mechanical structure, especially through the separate turbine. If the fluid is not entirely pure or for other reasons contains particles, the particles cannot be deposited between the turbine and the housing and impair the functioning of the nozzle. The significant portion of the fluid that is branched off for drive purposes is emptied through the bottom of the housing and is not led to the orifices.

A further rotating nozzle having a hollow shaft rotatably supported in a housing with a turbine torsionally joined therewith is known from EP 0 645 191 B1. The bearing of the shaft is obtained by a radial bearing surface on an axial bearing bore and an axial bearing surface. The turbine is set into rotation, or maintained in rotation, by an injector. The axial bearing surface acts as a friction brake controlled by the fluid pressure. It acts against the drive force generated by the fluid, with which the turbine is acted upon. Thereby, and over a broad pressure range, an excessively high nozzle rate of rotation can be prevented.

The nozzle has proved successful in practice. Certainly, with increasing fluid pressure, increased friction can occur on the friction brake, and accordingly there will be wear. Long term wear resistance can be obtained by choosing a suitable material, in the present case PTFE. However, the construction of the nozzle is somewhat complicated.

OBJECT AND SUMMARY OF THE INVENTION

Accordingly, in view of the foregoing, a general object of the present invention is to provide a rotating nozzle having a simple economic construction, high cleaning efficiency and a rotational behavior that is stable over a broad pressure range.

A further object of the present invention is to provide a nozzle of the foregoing type which is, to the extent possible, resistant to contamination and resistant to wear.

The nozzle of the invention includes at least one fluid drive which generates a drive torque and is connected with the nozzle body, and at least one breaking device which is likewise constructed as a fluid drive, and which delivers a torque opposed to the drive torque. The rate of rotation of the nozzle is thereby stabilized, i.e. the rate of rotation of the nozzle is prevented from increasing excessively when the fluid pressure increases. On the contrary, the nozzle already starts to rotate at a relatively high rate with low operating pressures. With increasing pressure, the rate of rotation first decreases to a minimal value, proceeding from which it then slowly climbs again with further increasing pressure. Low rates of rotation are thus possible even at high pressures. Thereby, a powerful jet with large drops and a large discharge distance can be generated which is suitable for thoroughly cleaning a container wall. Possible fluid sources include steam, a steam-and-water mixture, water, acid, lye, or possibly a particle-containing fluid.

For stabilizing the rate of rotation, a braking action is utilized. This is achieved by an oppositely directed torque which arises from separate fluid drives. This yields a braking effect independent from the state of wear of the bearings. Therefore, the nozzle is not very susceptible to wear. Moreover, by functionally separating the fluid drive from the braking arrangement, an uncoupling of the two drive arrangements is ensured. The drive effect and the braking effect are adjustable independently from one another, and can be adapted to the desired parameters, for example to the desired rate of rotation relation or to the size of the nozzle.

A nozzle that is largely resistant to contamination and resistant to wear can be provided by including a fluid drive that has a rotor which is formed by the housing of the nozzle body itself. To this end, the entering fluid stream is accelerated in a circumferential direction. Its torsion brings about the entrainment of the nozzle body, for example by friction. No rotating shaft, no turbine, and likewise no gear or other force-transferring mechanism is necessary, which makes the construction especially simple. Only the nozzle body rotates, otherwise, no other moving parts are included. The drive torque is generated directly on the housing. The housing is virtually free from any installed parts. By a corresponding construction of the housing inner wall and selection of the appropriate nozzle dimensions, a rate-of-rotation of the nozzle suitable for the working range of interest and the desired application can be ensured.

The construction according to the invention, in which all gaps, free spaces, and bearing places are traversed by the fluid, brings about self-cleaning of the nozzle. Therefore, the nozzle of the present invention is usable in the food and pharmaceutical fields, as well as other applications where special cleanliness is essential.

As desired, the nozzle can be made of metal, a metal alloy, plastic, ceramic material or the like.

Preferably, the housing is internally as well as externally rotation-symmetrical (e.g., cylindrical). The inner space can be free of built-in elements that disturb the flow, such as turbine blades or the like. Thereby, impairments of the spraying behavior are avoided.

A suitable design of the nozzle orifice a jet to be generated that emerges both in a radial and an axial direction altogether in fan form (flat jet). Several nozzle orifices can be provided that deliver circular-segment-like or fan-like fluid jets. The jet angle that is obtained when the individual jet segments are projected into a plane containing the axis of rotation generally covers 180°, in order to completely reach the inner wall of a container. Depending on the application, however, total jet angles of less than 180° can also be formed.

A pre-selected formation and arrangement of the nozzle orifice enables control of the axial force acting on the nozzle body (e.g., by recoil effects), to compensate for, or even completely to suspend such effects. Thereby, frictional forces and moments on axial surfaces can be minimized.

The drive can include a torsion-generating arrangement which forms the entry into the housing. The torsion of the fluid then drives the nozzle body in the direction of rotation.

With a suitable embodiment, the torque-generating arrangement is part of a slide-bearing element provided for the bearing of the nozzle body, in which the fluid inlet of the nozzle is provided. The torque-generating arrangement has one or more, preferably three, entry openings which connect the fluid inlet with the interior of the nozzle body in respect to flow, and which open in the radial direction and obliquely to the axial direction. Preferably, a section of the housing is seated on the torque-generating arrangement with little play. This section covers the radially opening sections of the inflow openings. Between the torque-generating arrangement and the housing there preferably is only a small, preferably annular step-free gap of about 0.01 mm to 0.2 mm, so that the bearing of the nozzle body is brought about by a fluid cushion of the in-flowing fluid. This type of slide bearing has proved to be especially sturdy. Advantageously, ball bearings can be eliminated.

If necessary, an arrangement (e.g., grooves or the like) can be provided in the housing for carrying along the housing by the fluid. Thereby, the drive effect can be reinforced.

The set-up of the braking arrangement for inhibiting rotation of the nozzle body is preferably formed by the outlet of the interior space of the nozzle body, i.e. one or more nozzle openings. The braking nozzle openings have a nozzle axis which does not intersect the axis of rotation of the housing. The emerging fluid jet produces a recoil that generates a torque which acts to brake the rotating body. In this manner, a stable rotary behavior is ensured, independent from the operating pressure.

The corresponding nozzle orifice is preferably somewhat elongated in the axial direction and inclined against the radial direction which intersects the orifice. The braking action produced by the nozzle orifice is preferably less than the drive effect of the drive arrangement. If necessary, the drive, however, can also be brought about by the recoil of the nozzle produced by the discharge of fluid through one or more orifices and the braking action can be brought about by the torque-generating arrangement.

Depending on the size of the nozzle, the desired rate of rotation and operating-pressure range, as well as the jet behavior, several such passage openings can be provided which serve as fluid-pressure dependent devices.

The nozzle body is rotatably supported on a bearing element on the one end of which the fluid inlet is present. The bearing element carries on its other end a rigid shaft, about which the nozzle body rotates. The free flow channel is formed between the shaft and the housing of the nozzle body which essentially contains no obstacles. A securing element is fastened to the free end of the shaft and can be released for purposes of cleaning.

Axial bearing surfaces on the bearing element and the securing element form, with their associated surfaces, a slide bearing on the nozzle body. No separate seal is provided. In operation, a leak occurs on the slide bearing surfaces, which provides fluid lubrication and reduces friction as well as wear.

These and other features and advantages of the present invention will be more readily apparent upon reading the following description of exemplary embodiments of the invention and upon reference to the drawings wherein:

While the invention will be described and disclosed in connection with certain preferred embodiments and procedures, it is not intended to limit the invention to those embodiments. Rather, it is intended to cover all such alternative embodiments and modifications as fall within the spirit and scope of the invention.

DETAILED DESCRIPTION OF EXEMPLARY EMBODIMENTS

Figure 1:
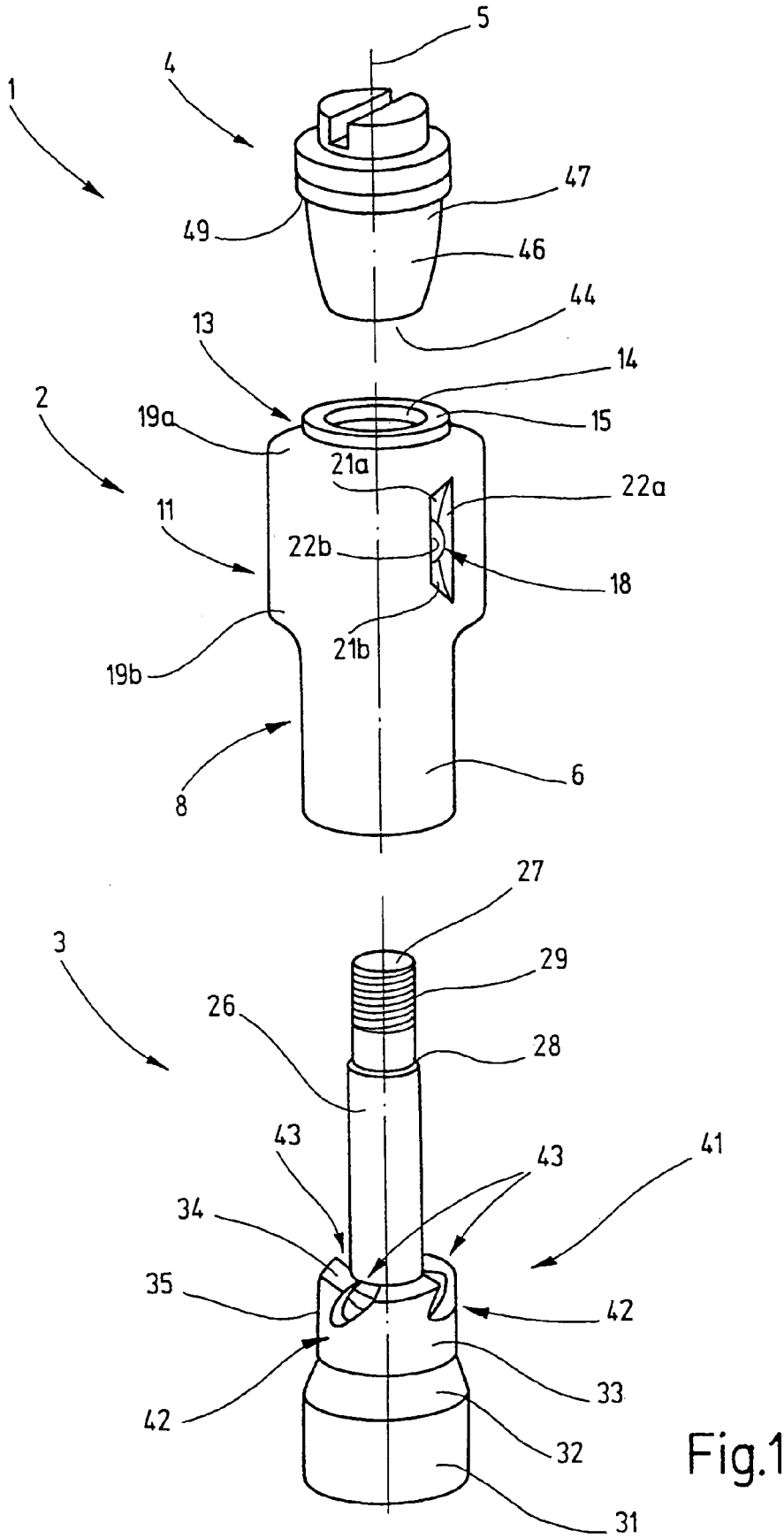
FIG. 1 is an exploded perspective view of an exemplary embodiment of the nozzle of the invention.
Figure 2:
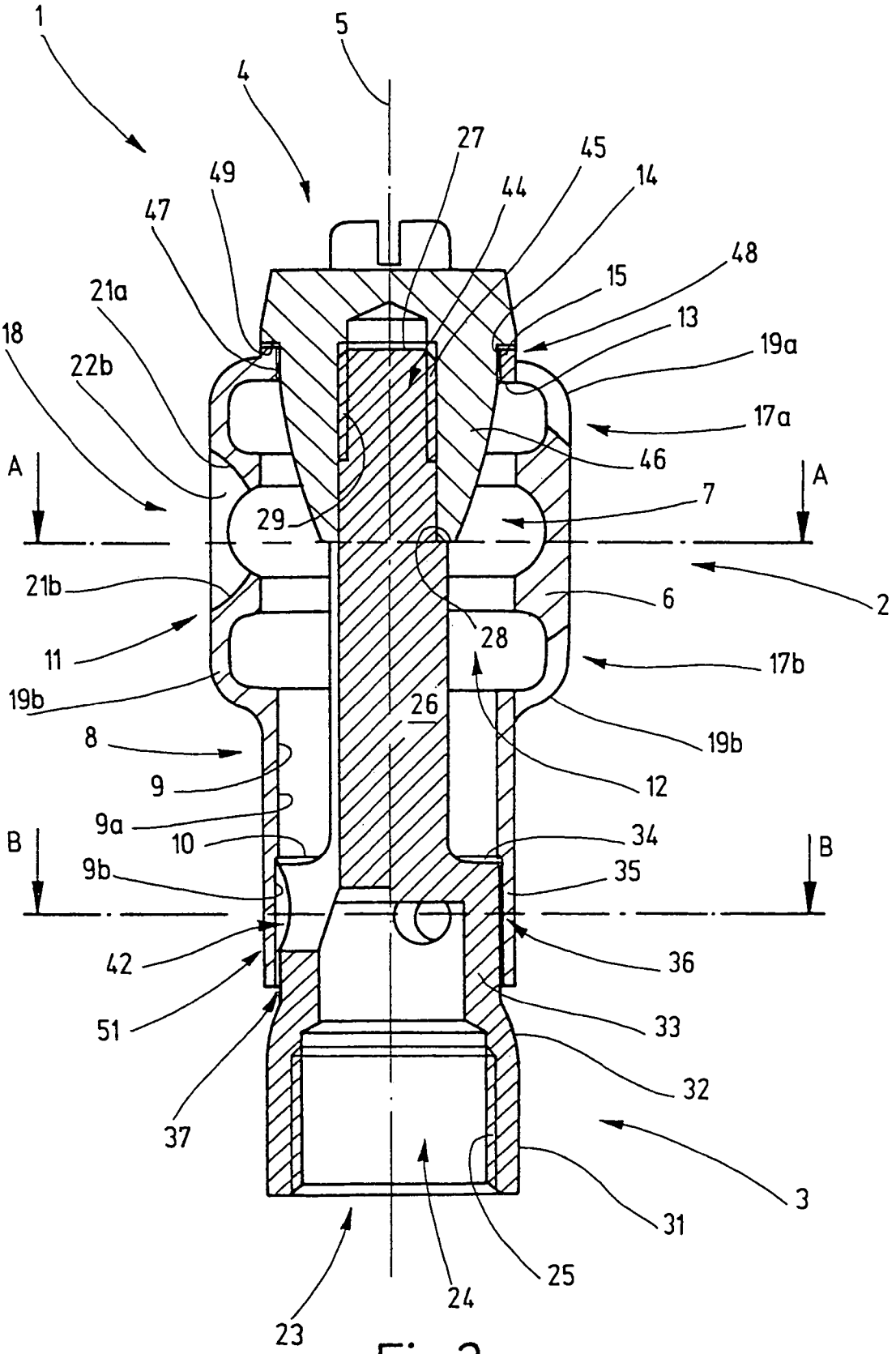
FIG. 2 is a partial longitudinal section view of the nozzle of FIG. 1.
Figure 3:
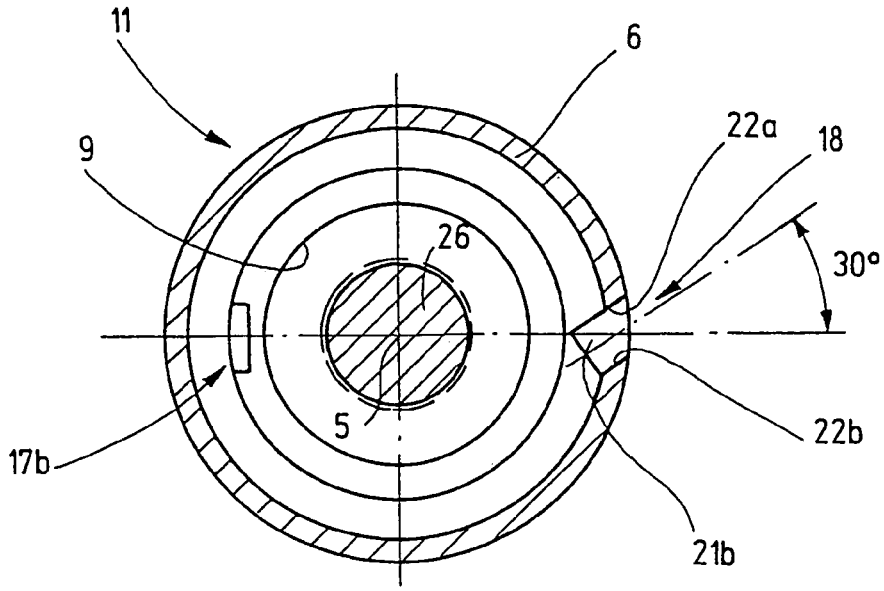
FIG. 3 is a cross-sectional view taken along the line A—A in FIG. 2 of the nozzle of FIG. 1.
Figure 4:
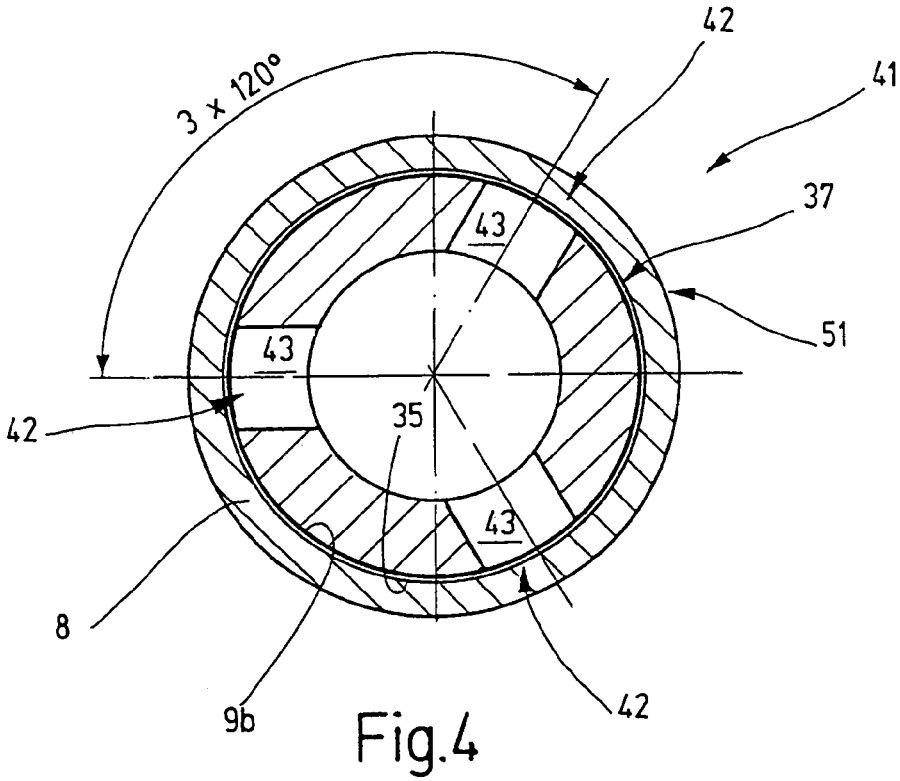
FIG. 4 is a cross-sectional view taken along the line B—B in FIG. 2 of the nozzle of FIG. 1.

In FIGS. 1 and 2, a nozzle 1 according to the invention is shown, which serves for generating of a fan-shaped, radially outward-directed discharge jet. The nozzle 1 includes a nozzle body 2, which as shown in FIG. 2, is arranged between a bearing element 3 and a securing element 4 and on which the nozzle body is rotatably supported.

The nozzle body includes a cylindrical housing 6 that is substantially rotationally symmetrical with respect to the rotation axis 5 and includes a cylindrical interior space 7. On a first end facing away from the securing element 4, the housing 6 is constructed as a tubular neck 8 with a cylindrical inner circumferential surface 9. A radially inward-projecting shoulder 10 divides the cylindrical inner circumferential surface 9 into a first cylindrical section 9*a* and a second section 9*b*, which forms the free end of the neck 8 and has a somewhat larger inside diameter with respect to the section 9*b*.

The neck 8 transitions into a section 11 of the housing having a relatively larger inner and outer diameter in relation to the neck 9 such that the inner space 7 is enlarged with the formation of a cylindrical chamber 12. After this section 11, an annular continuation 13 follows which has a cylindrical inner surface 14 and an annular face surface 15, which forms the upstream end of the housing 6 that faces the securing element 4 of the housing 6. The continuation 13 is arranged concentrically to the neck 8 and preferably has about the same inside diameter.

One or more openings 17*a*, 17*b*, 18 are arranged on section 11 for the formation of nozzle orifices. The openings 17*a*, 17*b* are formed as functional nozzle orifices in rounded transition sections 19*a*, 19*b* between section 11 and the continuation 13 or the neck 8. The openings generate a fan-shaped discharge jet, the boundaries of which are approximately the axial direction and the radial direction. According to the desired discharge jet configuration, other configurations of the nozzle orifice are also possible. The configuration of the nozzle orifices 17*a*, 17*b* and their arrangement in the oppositely lying transition sections 19*a*, 19*b* allow for an at least partial compensation of the axial force from the fluid acting on the nozzle body 2.

The opening 18 is arranged in the central area of the section 11 of the housing 6 between the openings 17*a*, 17*b* and spaced from these in the peripheral direction by 180°. The opening is bounded in the axial direction by walls 21*a*, 21*b* and in the peripheral direction by walls 22*a*, 22*b*, and has a trapezoidal shape when viewed from the side. The walls 21*a*, 21*b* are, for example, somewhat dome-like and they are inclined obliquely to the outlet surface. The opening 18 is enlarged in the axial direction toward the outside. The walls 22*a*, 22*b*, are axially aligned and preferably parallel to one another and arranged in the circumferential direction and inclined against the radial direction. Thereby, the corresponding nozzle orifice is arranged in such manner that it generates a reaction moment that counteracts the rotation of the nozzle body 11.

For the rotatable bearing of the nozzle body 2, the bearing element 3 is provided. The bearing element is provided on its one end with a fluid inlet 23 which is formed by an axial bore 24 with an inside thread 25. On the side of the bearing element 3 facing away from the fluid inlet 23, a shaft 26 is provided which has an outer thread 29 between its free end 27 and a step 28 projecting radially inward on the shaft.

The bearing element is constructed radially symmetrical with respect to the rotation axis 5. The bearing element has a first cylindrical wall section 31 surrounding the fluid inlet 23 as well as, following thereupon, a section 32 which is tapered with a curvature and extends into a cylinder section 33. The cylinder section 33, in which the axial bore 24 forming the fluid inlet 23 ends as a blind bore, has a face surface 34 as well as a mantle surface 35. On the face surface 34, the shoulder 10 of the neck 8 is supported in the static state. In operation (i.e., under fluid pressure), the shoulder 10 is somewhat lifted off from the face surface 34 and preferably does not contact the face surface.

The radius of the mantle surface 35 of the cylinder section 33 arranged coaxially to the axis 5 is somewhat less than the inside radius of the inner wall 9*b* of the neck 8. The remaining play serves as the bearing play of a slide bearing arrangement 36. Between the mantle surface 35 and the inner wall 9*b*, a gap 37, for example, can be formed of, for example, only about 0.1 mm in width. For reducing wear, the nozzle 1 is preferably made of a suitable material. Preferably, a corrosion-resistant metal, a ceramic material or a plastic is used.

The cylinder section 33 forms a torque-generating arrangement 41 which accelerates the in-flowing fluid in the peripheral direction. The cylinder section 33 has, for example, three equidistantly arranged entry openings 42. Each one of the entry openings is formed by a groove 43 intersecting the face surface 34 and the mantle surface 35. The grooves 43 are obliquely sloped with a pitch against the axial direction (in the manner of a steep thread) and are in connection with the axial bore 24.

The nozzle body 2 is secured on the bearing element 3 by the securing element 4 which has an axial bore 44 with an inside thread 45. A flow body 46 of the securing element 4 arranged in the interior space 7 of the nozzle body 2 has an arcuate outer wall that widens in the flow or downstream direction, so that the fluid is deflected with only slight resistance to the nozzle orifice 17*a*. The fluid is hardly swirled and the spraying characteristics are not impaired. Following upon the flow body 46, an annular bearing surface 47 is provided which, with the inner surface 14 of the continuation 13, forms a further slide bearing arrangement 48 for the nozzle body 2. The bearing play amounts to approximately 0.1 mm. Further, connected to the bearing surface 47, an axial bearing surface 49 is provided which, with the face surface 15 of the continuation 13, fixes the nozzle body in the axial direction with little play. No additional seal is required or provided on the two slide bearing arrangements 36 and 48.

The operation of the nozzle 1 that has been described so far is as follows:

The fluid passes over the fluid inlet 23 to the entry openings 42 of the torque-generating arrangement 41 which forms the entrance to the interior space 7. The fluid jet is guided, through the entry openings 42 into the interior space in three partial jets with torque. The torque-generating grooves 43 are arranged at about an angle of 35 to 55°, preferably around 45°, to the axis of rotation. The entering fluid stream is first deflected radially outward and, furthermore, in the circumferential direction. The fluid flowing with force strikes the inner wall of the neck 8 and of the housing 6. There arises an entraining effect which generates a torque acting on the housing 6, and that causes housing 6 to rotate. The torque-generating arrangement 41 and the housing 6 thus form a first fluid drive 51 for the nozzle body 2.

The fluid that has entered the housing 6 leaves the openings 17*a*, 17*b*, 18 in each case in jet-form. The jets are in each case fan-shaped and are combined altogether into a fan-shaped jet which extends, proceeding from the axis of rotation 5, over 180° up to the axis of rotation 5. The fan is divided into individual partial fans which are allocated to the respective nozzle orifices. The partial fans can be offset in peripheral direction.

The jet emerging from the lateral nozzle orifice, i.e. the opening 18, generates a reaction force which acts on the housing. The direction of the reaction force produced, however, does not intersect the axis of rotation 5. For example, the force direction is offset by approximately 30° against the radial direction. Thereby, a braking torque that acts on the housing 6 is produced. The lateral nozzle orifice 18 thereby forms a braking device. The torque that acts with the braking effect corresponds to the recoil which the emerging jet exerts on the housing 6 and is thus dependent on pressure. The recoil produced tends to increases with increasing pressure.

The drive moment corresponds to the torque of the fluid entering the housing 6 and it tends to increase on an increase of the fluid velocity and therefore on an increase of the fluid pressure. At very low pressures, such as for example, below 0.5 bar, the braking effect of the recoil on wall 22*a* is slight and is exceeded by the driving torque produced by the torsion of the fluid. Therefore, the nozzle rotates at, for example, 30 rpm. With increasing pressure, the recoil braking becomes active on the opening 18. Therefore, the rate of rotation falls to values of, for example, 2 rpm to 4 rpm at 1 bar. The housing 6 and its bearing areas are formed in such manner that virtually no axial force acts on the housing 6, where at the bearing points braking friction hardly manifests itself. Furthermore, the axial thrust of the housing 6 can be controlled through the configuration of the nozzle orifices 17*a*, 17*b* and 18.

With increasing pressure, the rate of rotation of the nozzle body 6 again gradually increases. For example, the increase can be linear with a flat rise of the curve. Tests show at 20 bar a revolution number of 24 rpm. The nozzle shows, therefore, a self-stabilizing function of the rate of rotation. The slow but stable revolution of the housing 6 permits the emergence of the fluid with great throw distance and good cleaning action even on large containers at a high pressure.

Figure 5:
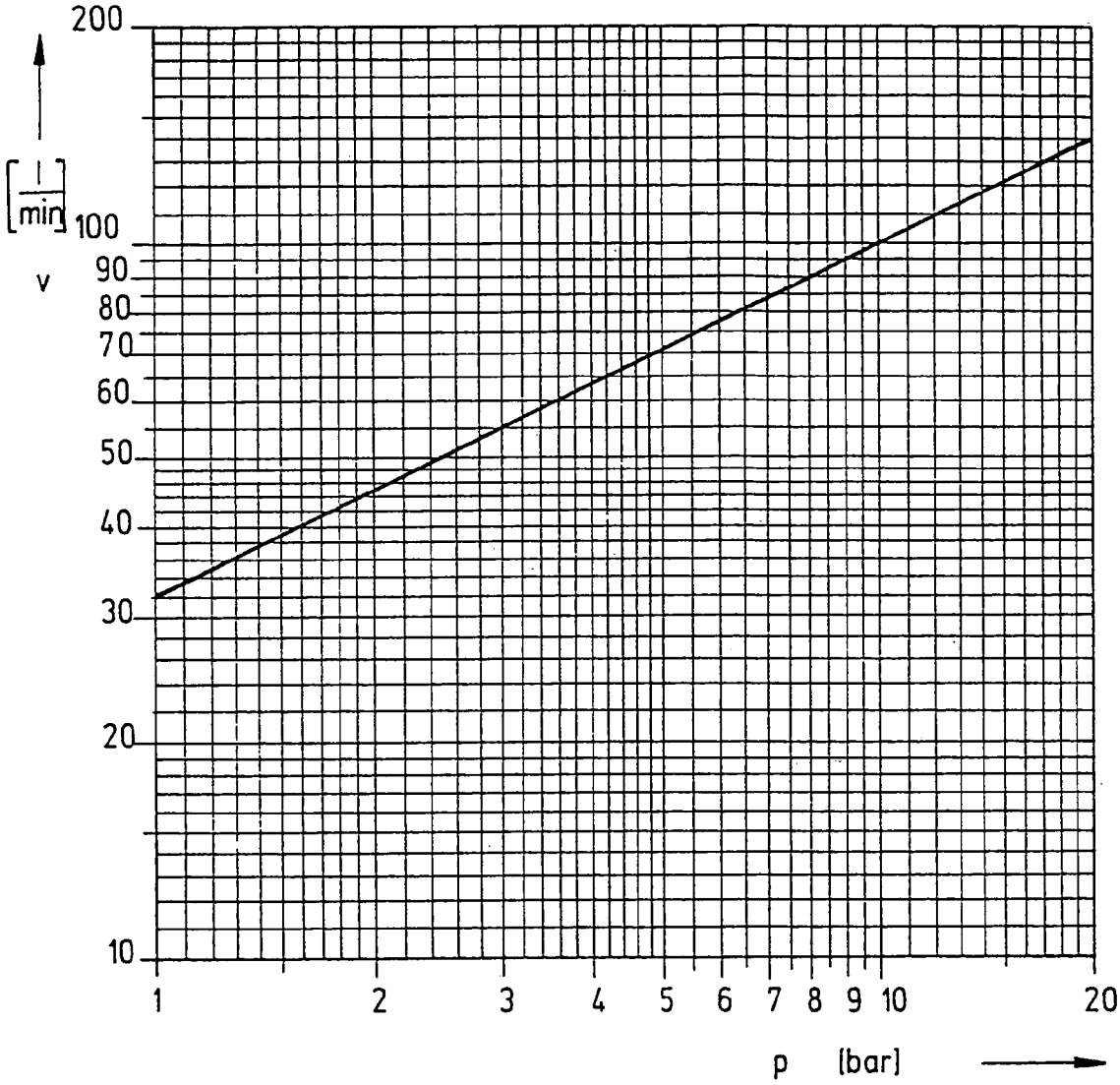
FIG. 5 is a graph illustrating the dependence of the flow amount v on the operating pressure p.
Figure 6:
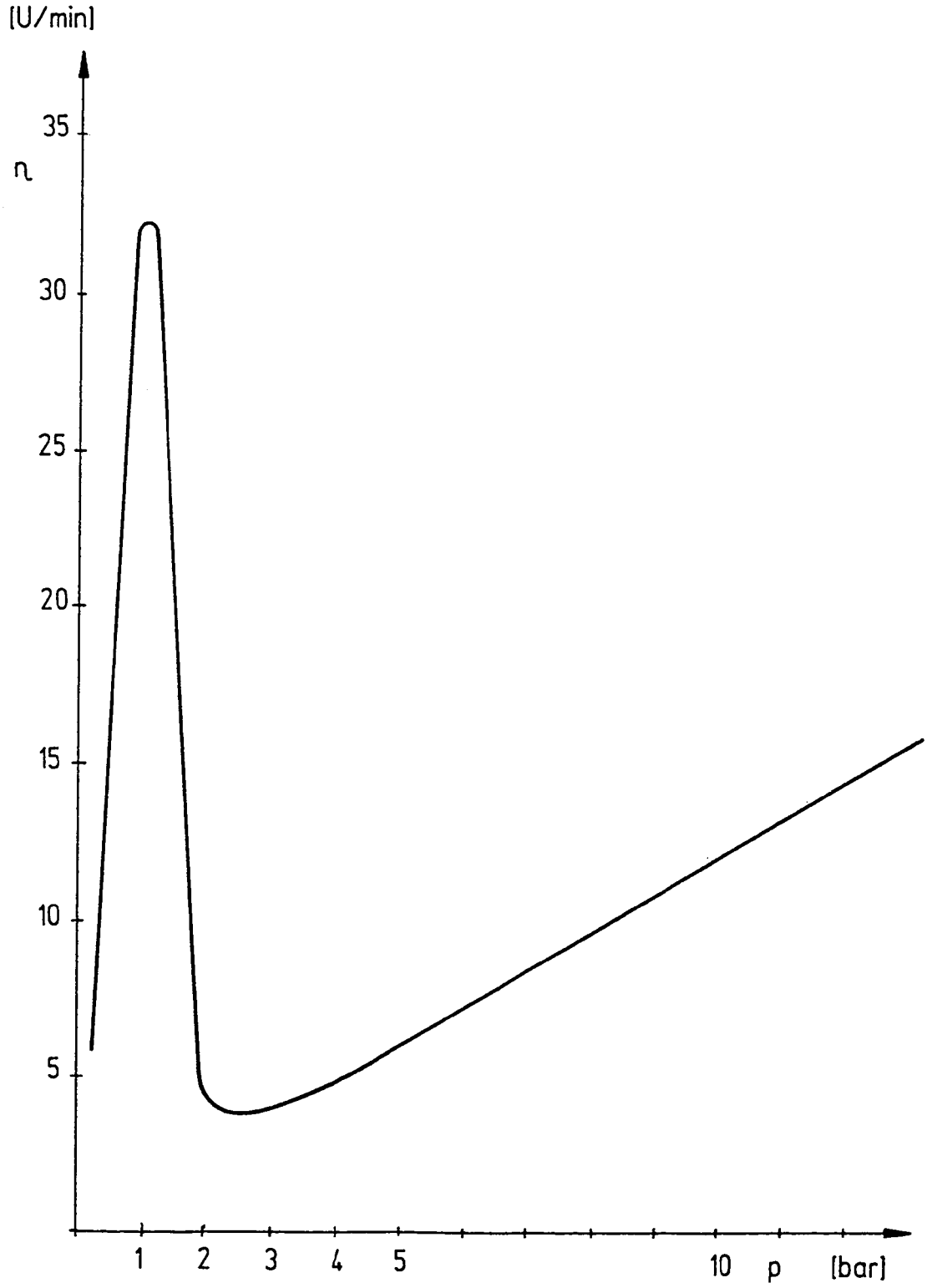
FIG. 6 is a graph illustrating the dependence of the rate of rotation n on the operating pressure p.

With the nozzle design of the present invention, the interior space of the housing can be formed completely free. In particular, no installations or the like are required. Thereby, the spraying behavior of the individual nozzle openings on the nozzle body 2 is not disturbed and the emerging fluid jet is not influenced, as can be the case if turbines or the like are accommodated in the housing. Furthermore, there appears to be a linear relation between the fluid pressure and the flow amounts, as FIG. 5 illustrates. The nozzle has a low inner flow resistance which is of importance, especially at higher pressures and therefore at higher flow speeds. Thus, the nozzle can be used not only at very low pressures and with fluids of low density, such as air, steam or foam, but with liquids with high pressure that aim at a good cleaning effect.

In the illustrated embodiment, the driving of the rotation of the nozzle is brought about through the drive device 51, and the braking is brought about by the braking device 18. The speed/pressure characteristic curve has a dish-shaped course. A similar stabilized characteristic curve can also be obtained if the opening 18 generates a predominating moment and acts as the drive while the drive device 51 is weaker and acts as brake.

Figure 7A:
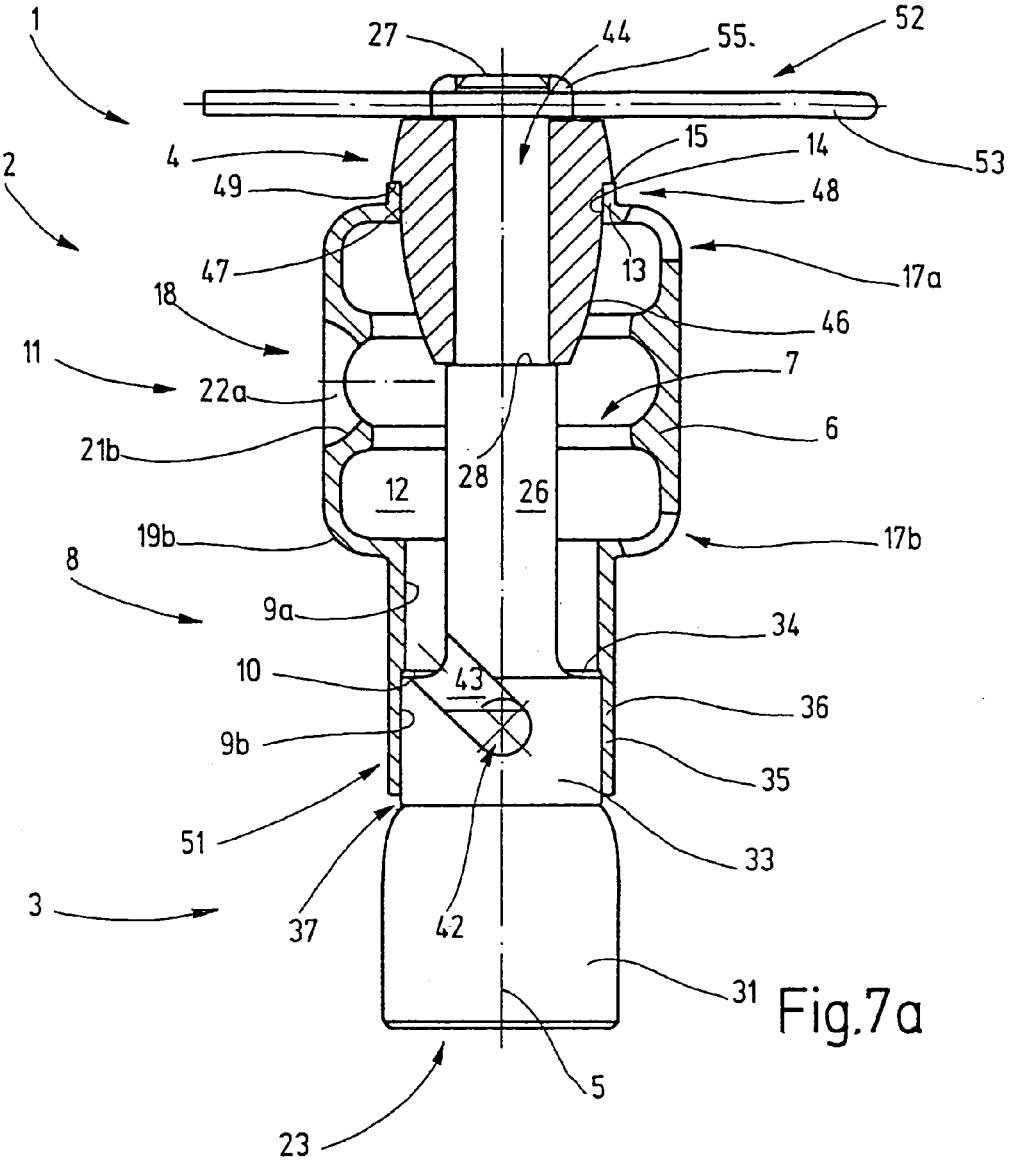
FIG. 7*a* is a partial longitudinal section view of a further embodiment of a nozzle according to the invention.
Figure 7B:
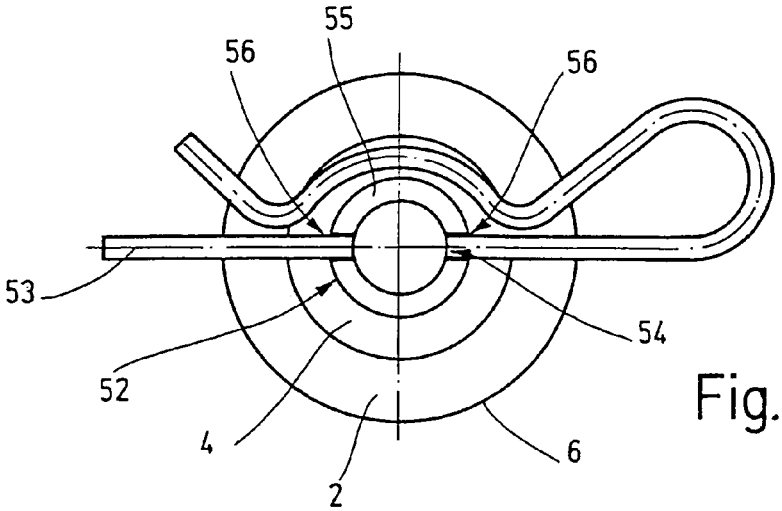
FIG. 7*b* is a plan view of the nozzle of FIG. 7*a*.

In FIG. 7*a*, 7*b* there is illustrated another embodiment of the nozzle of the present invention. Insofar as the construction and/or function of a component is the same as the nozzle described above, the same reference numbers are used.

The embodiment shown in FIGS. 7*a* and 7*b* differs from that represented in FIGS. 1 to 4, especially in that instead of the screw connection 29, 45, there is provided a pin securing 52 for fastening of the securing element 4 to the bearing element 3. To this end, the axial bore 44 of the securing element 4 is constructed as a central bore. A spring plug 53 serves as a pin which is made of a springy material. The spring plug is inserted into a passage bore 54 on the free end 27 of the axis 26, in order to fix the nozzle 1 in the axial direction. In order to give additional securing against twisting to the securing element 4, passage bores or radial grooves 56 receiving the spring plug 53 can be provided on a close-off cap 55 of the securing element 4. The advantage of the pin securing 52, or that of a corresponding securing device from the outside, lies in that the central bore 44 as well as the shaft 26 can be joined with one another without a screw thread and therefore in a smooth-walled manner that has few gaps, especially no labyrinth gaps. Dirt particles or the like can hardly be lodged in the remaining gaps because they can be rinsed by the fluid. This allows the nozzle to be used in the pharmaceutical and food fields.

In the embodiment of the invention shown in FIGS. 7*a* and 7*b*, the grooves 43 forming the torque-generating device 41 are aligned in the direction opposite the direction shown in the embodiment according to FIGS. 1 to 4, so that the nozzle body 2, seen here in the flow direction, is driven counter-clockwise. Accordingly, to obtain the desired braking effect, the lateral nozzle orifice 18 is also inclined in the other direction against the radial direction.

A nozzle for particular use in cleaning applications is provided which includes rotatably supported nozzle body on which one or more nozzle orifices are provided. The nozzle housing itself serves as the rotary drive, which is carried along by a fluid led into the housing with torque. In order to stabilize the drive action, at least one braking device is provided on the nozzle which generates a braking torque by fluid action, preferably through the recoil on a nozzle opening.

What is claimed is:

1. A nozzle assembly for discharging a fluid for cleaning containers, comprising:

a rotatable nozzle housing having a cylindrical chamber, a first fluid drive for applying a first torque on the nozzle housing and thereby rotating the nozzle housing, said nozzle housing being formed with a braking fluid discharge opening having an orientation that opens outwardly of the said cylindrical housing chamber in the direction of rotation of the nozzle housing for directing liquid outwardly of said housing to retard the rotation of said nozzle housing as an incident to the direction of pressurized fluid through said nozzle housing, and said nozzle housing being formed with at least one spray discharge orifice of a first form that opens outwardly of said cylindrical housing chamber with an orientation different from said breaking fluid discharge opening substantially in a radial direction for discharging a predetermined fluid spray from said rotatable housing in a radial direction as an incident to the direction of pressurized fluid through said housing and rotation of said housing, and said nozzle housing being formed with a braking fluid discharge opening having an axis that does not intersect the axis of rotation of the nozzle housing and which is oriented such that the braking fluid discharge opening opens outwardly of the said cylinderical housing chamber in the direction of circumferential rotation of the nozzle housing for directing liquid outwardly of said housing to retard the rotation of said nozzle housing as an incident to the direction of pressurized fluid through said nozzle housing.

2. The spray nozzle assembly of claim 1 in which said at least one spray discharge nozzle orifice of the first form is located in axially offset relation to said braking discharge opening.

3. The spray nozzle assembly of claim 1 in which said at least one spray discharge nozzle orifice of the first form is located in circumferentially offset relation to said braking discharge opening.

4. The spray nozzle assembly of claim 1 in which said at least one spray discharge nozzle orifice of the first form is located in axial and circumferential offset relation to said braking discharge opening.

5. The spray nozzle assembly of claim 1 in which said housing is formed with a plurality of said spray discharge nozzle orifices of the first form.

6. The spray nozzle assembly of claim 5 in which said nozzle orifices of the first form are in axially spaced relation to each other.

7. The spray nozzle assembly of claim 6 in which said braking discharge opening is at an axial location intermediate said nozzle orifices of the first form.

8. The spray nozzle assembly of claim 1 in which said braking discharge opening and said at least one spray discharge nozzle orifice of the first form are formed in diametrically opposed sides of said housing.

9. The spray nozzle assembly of claim 1 in which said braking discharge opening has an elongated configuration with a long axis thereof parallel to said axis of rotation.

10. A nozzle according to claim 1, wherein the nozzle is made of a corrosion-resistant metal.

11. A nozzle according to claim 1, wherein said nozzle housing has a cylindrical shape and encloses a substantially rotationally symmetrical interior space which is traversed by fluid, and said first fluid drive includes a torque-generating device which imparts a torque to the fluid.

12. A nozzle according to claim 11, wherein the torque-generating device is arranged at an entrance to the interior space and includes at least one entry opening leading from a fluid inlet to the interior space.

13. A nozzle according to claim 11, wherein the torque-generating device comprises a cylindrical section which is part of a bearing element arranged to rotatably support the nozzle housing, the cylindrical section having a mantle surface as well as an annular face surface facing in a flow direction, an entry opening in the form of a groove which is open to the mantle surface and the face surface, the groove extending so as to be inclined to the axial direction, and a small gap for bearing of the housing being established between the mantle surface and the housing of the nozzle housing and arranged concentrically thereto.

14. A nozzle according to claim 11, wherein a plurality of entry openings are provided, which are arranged equidistant from each other in the circumferential direction.

15. A nozzle according to claim 1, wherein said nozzle housing has a plurality of said spray discharge orifices of the first form formed therein which are configured so as to produce a fan shaped fluid jet which is divided into a plurality of segments.

16. A nozzle according to claim 1, wherein said a breaking discharge opening is effective for causing a reaction force counter to the rotation of said housing as an incident to the direction of pressurized fluid through said housing and braking discharge opening.

17. A nozzle according to claim 16, wherein the breaking discharge opening is bounded circumferentially by a first wall aligned substantially axially that is inclined outward in a turning direction and upon which the discharging fluid exerts a recoil force which retards the nozzle housing in its rotation movement.

18. A nozzle according to claim 17, wherein a second wall circumferentially bounds the breaking discharge opening, the second wall arranged approximately parallel of the first wall and ahead of the first wall in the direction of rotation of the nozzle housing.

19. A nozzle according to claim 1, further including a bearing element for supporting the nozzle housing, the bearing including a securing element having an axial bearing surface and a radial bearing surface for the nozzle housing.

20. A nozzle according to claim 19, wherein a radially outwardly projecting annular shoulder is provided on the bearing element which along with the axial bearing surface of the securing element secures the nozzle head in the axial direction.

21. A nozzle according to claim 20, wherein the axial bearing surface of the securing element serves as a seal and said seal being the only sealing provided for the nozzle housing in the area of the axial bearing surface.

22. A nozzle according to claim 19, further including a slide bearing arrangement for rotatably supporting the nozzle housing and wherein the slide bearing arrangement comprises a cylindrical mantle surface on the bearing element that is aligned radially outward and coaxially to the axis of rotation and the radial bearing surface of the securing element.

23. A nozzle according to claim 22, wherein a fluid leak is provided to lubricate the slide bearing arrangement and the radial bearing surface.

24. A nozzle according to claim 1, further including a slide bearing arrangement for rotatably supporting the nozzle housing.

25. A nozzle assembly for discharging a fluid for cleaning containers, comprising:

a rotatable nozzle housing having a nozzle orifice formed therein for discharging fluid from the nozzle housing, said nozzle housing having a cylindrical shape and enclosing a substantially symmetrical interior space which is transversed by the fluid, a first fluid drive that includes a torque generating device for imparting torque to fluid and for applying a first torque on the nozzle housing and thereby rotating the nozzle housing, and a braking device comprising a second fluid drive that is separate from the first fluid drive and which is arranged to retard the rotation of the nozzle housing, and said torque-generating device including a cylindrical section which is part of a bearing element arranged to rotatably support the nozzle housing, said cylindrical section having a mantle surface as well as an annular face surface facing in a flow direction, an entry opening in the form of a groove which is open to the mantle surface and the face surface, said groove extending so as to be inclined to the axial direction, and a small gap for bearing of the nozzle housing established between the mantle surface and the nozzle housing and arranged concentrically thereto.

26. A nozzle assembly for discharging a fluid for cleaning containers, comprising:

a rotatable nozzle housing having a nozzle orifice formed therein for discharging fluid from the nozzle housing, a first fluid drive for applying a first torque on the nozzle body and thereby rotating the nozzle housing, a braking device comprising a second fluid drive that is separate from the first fluid drive and which is arranged to retard the rotation of the nozzle housing, said braking device including a breaking discharge opening provided in the housing from which discharging fluid brings about a reaction force, said breaking discharge opening being bounded circumferentially by a first wall aligned substantially axially that is inclined outward in a turning direction and upon which the discharging fluid exerts a recoil force which retards the nozzle housing in its rotation movement and a second wall approximately parallel of the first wall and ahead of the first wall in the direction of rotation of the nozzle housing.

27. A nozzle for discharging a fluid for the cleaning of containers comprising, a rotatable nozzle body including a housing having a nozzle orifice formed therein for discharging fluid from the nozzle, a fluid drive including a rotor formed by the housing of the nozzle body which is driven by the action of the fluid, a torque-generating device including a cylindrical section which is part of a bearing element arranged to rotatably support the nozzle body, said cylindrical section having a mantle surface as well as an annular face surface facing in a flow direction, an entry opening in the form of a groove which is open to the mantle surface and the face surface, said groove extending so as to be inclined to the axial direction, and a small gap for bearing of the housing being established between the mantle surface and the housing of the nozzle body and arranged concentrically thereto.

* * * * *